US006896302B2

(12) United States Patent
Belchine, III et al.

(10) Patent No.: US 6,896,302 B2
(45) Date of Patent: May 24, 2005

(54) PUSH BUTTON RELEASE APPARATUS

(75) Inventors: Walter Belchine, III, Plainfield, IL (US); Robert N. Templeman, Crown Point, IN (US)

(73) Assignee: Illinois Tool Works Inc., Glenview, IL (US)

( * ) Notice: Subject to any disclaimer, the term of this patent is extended or adjusted under 35 U.S.C. 154(b) by 52 days.

(21) Appl. No.: 10/219,954

(22) Filed: Aug. 15, 2002

(65) Prior Publication Data

US 2003/0047951 A1 Mar. 13, 2003

Related U.S. Application Data

(60) Provisional application No. 60/313,152, filed on Aug. 17, 2001.

(51) Int. Cl.[7] ..... E05B 3/00

(52) U.S. Cl. ..... 292/336.3; 292/110; 292/225; 292/DIG. 37; 74/110

(58) Field of Search ..... 292/336.3, 225, 292/DIG. 37, DIG. 61, DIG. 68; 74/110

(56) References Cited

U.S. PATENT DOCUMENTS

| | | | | | |
|---|---|---|---|---|---|
| 222,907 | A | * | 12/1879 | Holmes | 292/166 |
| 1,795,590 | A | * | 3/1931 | Adams | 292/173 |
| 2,658,781 | A | * | 11/1953 | Allen | 292/216 |
| 2,726,889 | A | * | 12/1955 | Lawson | 292/170 |
| 2,989,333 | A | * | 6/1961 | Fox | 292/280 |
| 3,018,652 | A | * | 1/1962 | Dubonnet | 70/218 |
| 3,036,453 | A | * | 5/1962 | Dubonnet | 70/207 |
| 3,054,634 | A | * | 9/1962 | Westerdale | 292/336.3 |
| 3,113,798 | A | * | 12/1963 | Kramer | 292/336.3 |
| 3,162,374 | A | * | 12/1964 | Skokut | 362/501 |
| 3,194,596 | A | * | 7/1965 | Jakeway | 292/336.3 |
| 3,649,061 | A | * | 3/1972 | Meyer | 292/336.3 |
| 3,767,244 | A | * | 10/1973 | Plaw | 292/227 |
| 4,482,179 | A | * | 11/1984 | Johnson | 292/336.3 |
| 4,684,175 | A | * | 8/1987 | Trutter | 297/378.13 |
| 4,779,927 | A | * | 10/1988 | Trutter et al. | 297/378.13 |
| 4,883,296 | A | * | 11/1989 | Laurie | 292/336.3 |
| 4,886,310 | A | * | 12/1989 | Cyr et al. | 292/336.3 |
| 5,096,917 | A | * | 3/1992 | Sallmann et al. | 514/415 |
| 5,551,737 | A | * | 9/1996 | Clavin | 292/169 |
| 5,558,372 | A | | 9/1996 | Kapes et al. | 292/336.3 |
| 5,700,056 | A | * | 12/1997 | Bernard | 297/378.13 |
| 5,944,369 | A | | 8/1999 | Kapes | 292/336.3 |
| 6,007,122 | A | | 12/1999 | Linder et al. | 292/336.3 |
| 6,106,036 | A | * | 8/2000 | Okada et al. | 292/336.3 |

* cited by examiner

*Primary Examiner*—Daniel P. Stodola
*Assistant Examiner*—Carlos Lugo
(74) *Attorney, Agent, or Firm*—Mark W. Croll; Paul F. Donovan

(57) ABSTRACT

A push button release apparatus for releasing a door of a vehicle has a housing secured to the door of the vehicle. The housing defines a cavity. A push button supported by the housing is slidable relative to the housing and moves between an inoperative location and an operative location. A cam device pivotally supported about a pivotal axis has a first termination defining a cam surface that cooperates with the push button and a second termination connected to a cable. When the push button is moved from the inoperative location toward the operative location the cam rotates about the pivotal axis and the second termination of the cam device moves, pulling the cable for releasing the door of the vehicle.

15 Claims, 8 Drawing Sheets

PUSH BUTTON RELEASE APPARATUS

CROSS-REFERENCE TO RELATED APPLICATION

This application claims benefit to U.S. provisional application Ser. No. 60/313,152, filed on Aug. 17, 2001.

FIELD OF THE INVENTION

The present invention relates generally to a push button release apparatus. More particularly, the present invention relates to a push button release apparatus for releasing a door of a vehicle.

BACKGROUND OF THE INVENTION

Mini-vans and many other types of vehicles include a sliding door having a latch and release mechanism. One such mechanism is shown and described in U.S. Pat. No. 6,106,036. One problem with the mechanism of this prior patent concerns the amount of force that is necessary to operate the release device on account of the cam for the release device having to move and slide along a linear slot. The linear action of the cam results in an undesirable amount of friction which must be overcome in order to operate the release device. Thus, although this prior arrangement and other arrangements have been considered to operate in a somewhat satisfactory manner in the past, there is still a continual need for new and improved latch and release mechanisms that are easier to operate, economical to manufacture, and yet also being made of durable construction and quality to allow for repeatable use.

SUMMARY OF THE INVENTION

Accordingly, the present invention provides a push button release apparatus for releasing a door of a vehicle that overcomes the aforementioned problems and other problems of the prior art. The present invention provides a simple yet reliable arrangement for safely disengaging the release mechanism so that opening of a door is permitted. The arrangement according to the present invention enables a user to apply a relatively slight pressure on a release button to depress the button so that the release mechanism is unlatched.

More particularly, the apparatus according to the present invention includes a release button, a cam, a biasing device, and a housing therefor. The housing is mounted to a vehicle door, such as a sliding door. When the release button is depressed, it pushes on the cam which is then caused to rotate about a fixed axis. An unlocking cable is operatively connected to the cam, so that when the release button is depressed, the cable is pulled or otherwise manipulated so as to unlock the door. After the release button has been fully depressed, the biasing device causes the release button to return to its original position. Because the cam is configured to rotate about a fixed axis as compared to moving and sliding along a linear slot, less force is required to operate the push button to open the door, thereby resulting in an improved, more user friendly device.

Other features and advantages of the invention will become apparent to those skilled in the art upon review of the following detailed description, claims and drawings in which like numerals are used to designate like features.

Figure 1:
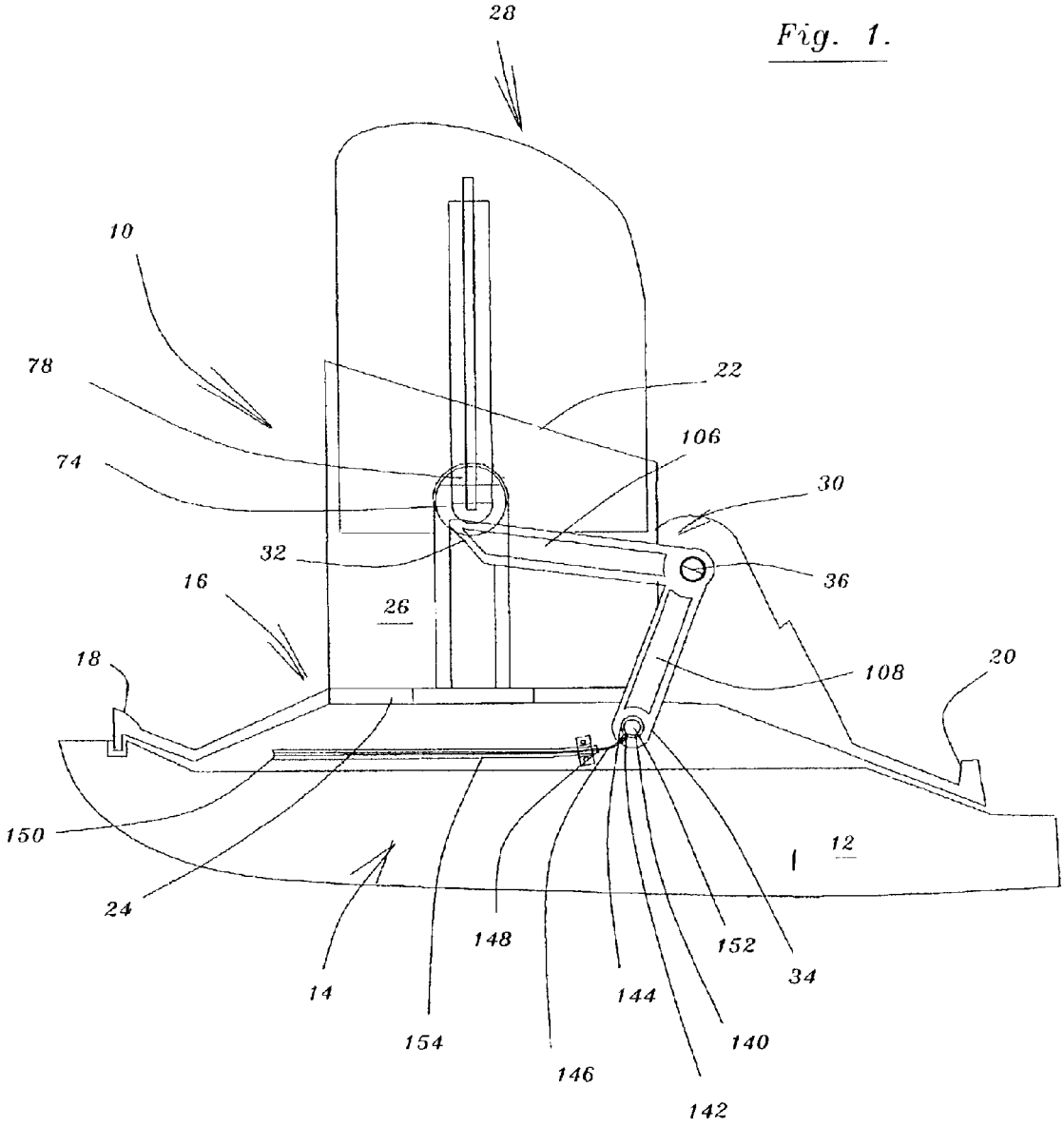
FIG. 1 is a side elevational view of a push button release apparatus according to the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

FIG. 1 is a side elevational view of a push button release apparatus generally designated 10 according to the present invention for releasing a door 12 of a vehicle 14. As shown in FIG. 1, the apparatus 10 includes a housing generally designated 16 that is secured to the door 12 of the vehicle 14. The housing 16 has a first and a second end 18 and 20 respectively and a first and a second extremity 22 and 24 respectively. The housing 16 defines a cavity 26 which extends between the first end 18 and the second end 20 of the housing 16, and between the first and the second extremities 22 and 24 respectively of the housing 16. A push button generally designated 28 is supported by the housing 16, the push button 28 being slidably disposed relative to the housing 16. The arrangement is such that the push button 28 moves from an inoperative location that is shown in FIG. 1, in which the push button 28 is disposed adjacent to the first extremity 22 of the housing 16.

Figure 2:
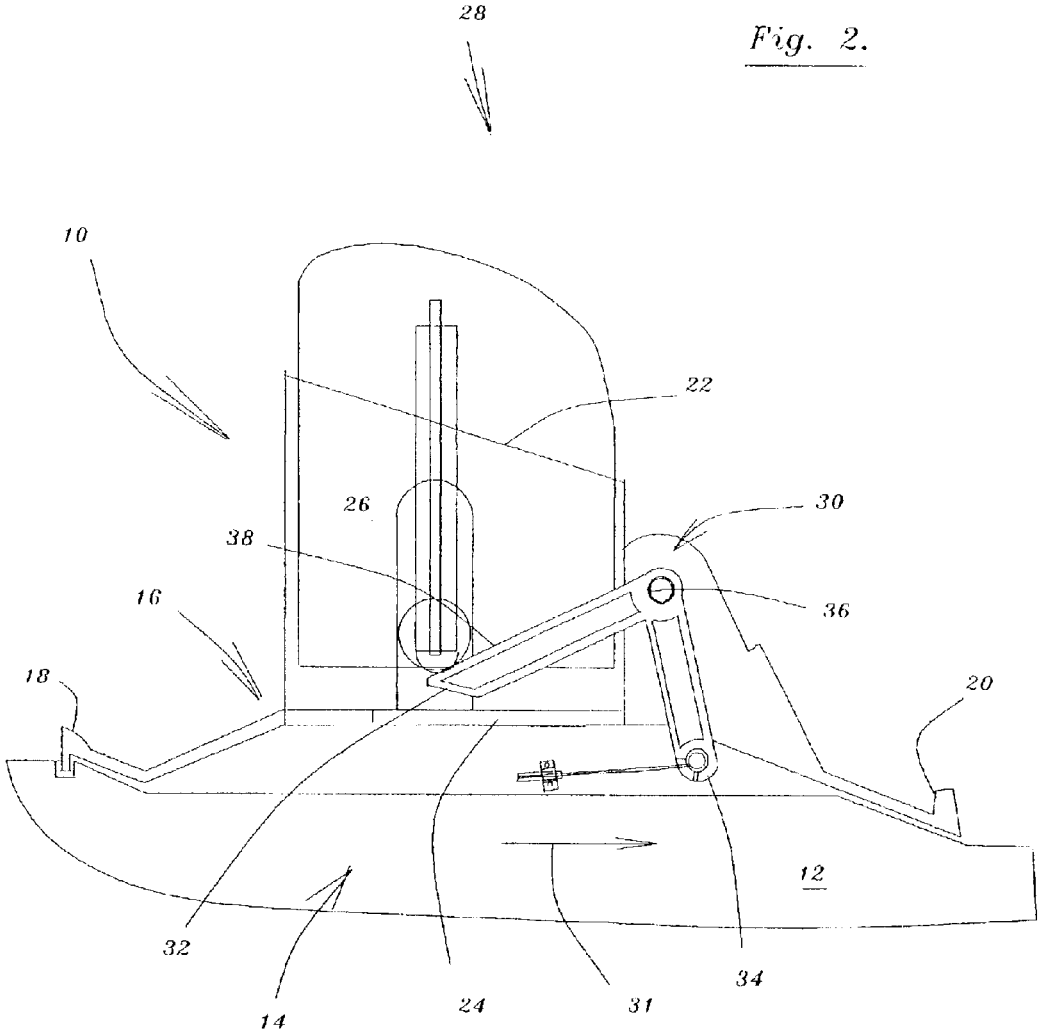
FIG. 2 is a similar view to that shown in FIG. 1 but shows the push button in an operative location.

FIG. 2 is a similar view to that shown in FIG. 1 but shows the push button 28 in an operative location. As shown in FIG. 2, the push button 28, in the operative location, thereof, is disposed adjacent to the second extremity 24 of the housing 16. A cam 30 has a first and a second termination 32 and 34 respectively, the cam 30 being pivotally supported about a pivotal axis 36 which is disposed between the first and the second termination 32 and 34 respectively of the cam 30. The pivotal axis 36 extends through the housing 16, the first termination 32 defining a cam surface 38 that cooperates with the push button 28.

Figure 3:
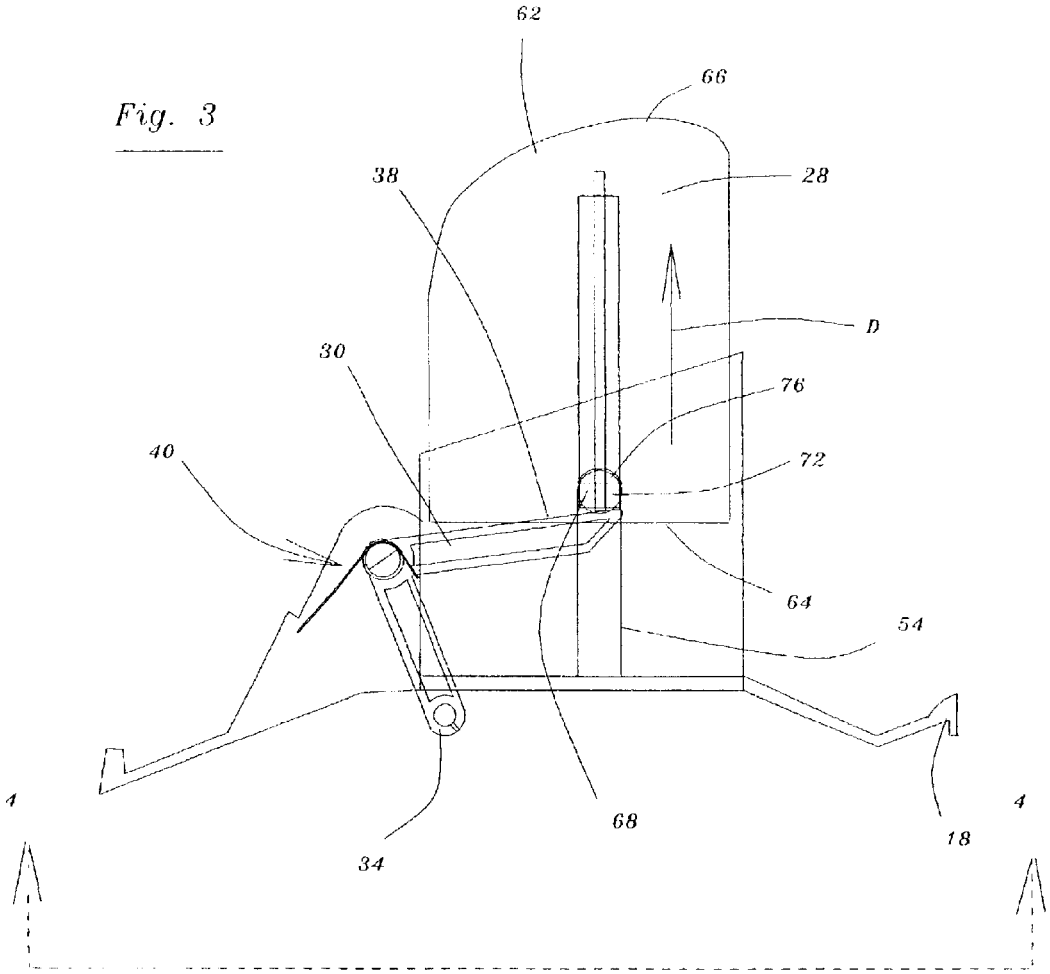
FIG. 3 is a similar view to that shown in FIG. 1 but shows the apparatus viewed from the opposite side.

FIG. 3 is a similar view to that shown in FIG. 1 but shows the apparatus 10 viewed from the opposite side. As shown in FIG. 3, a biasing device generally designated 40 is connected to the cam 30. The arrangement is such that the cam surface 38 urges the push button 28 in a direction D from the operative location shown in FIG. 2, towards the inoperative location thereof shown in FIG. 1. Therefore, when the push button 28 is moved from the inoperative location shown in FIG. 1, towards the operative location shown in FIG. 2, the second termination 34 of the cam 30 moves as indicated by the arrow 31 (FIG. 2), so as to cause the release of the door 12 of the vehicle 14.

In a more specific embodiment of the present invention, the housing 16 is fabricated from a plastic material. Also, the housing 16 is a one-piece molding and preferably is injection molded.

Figure 4:
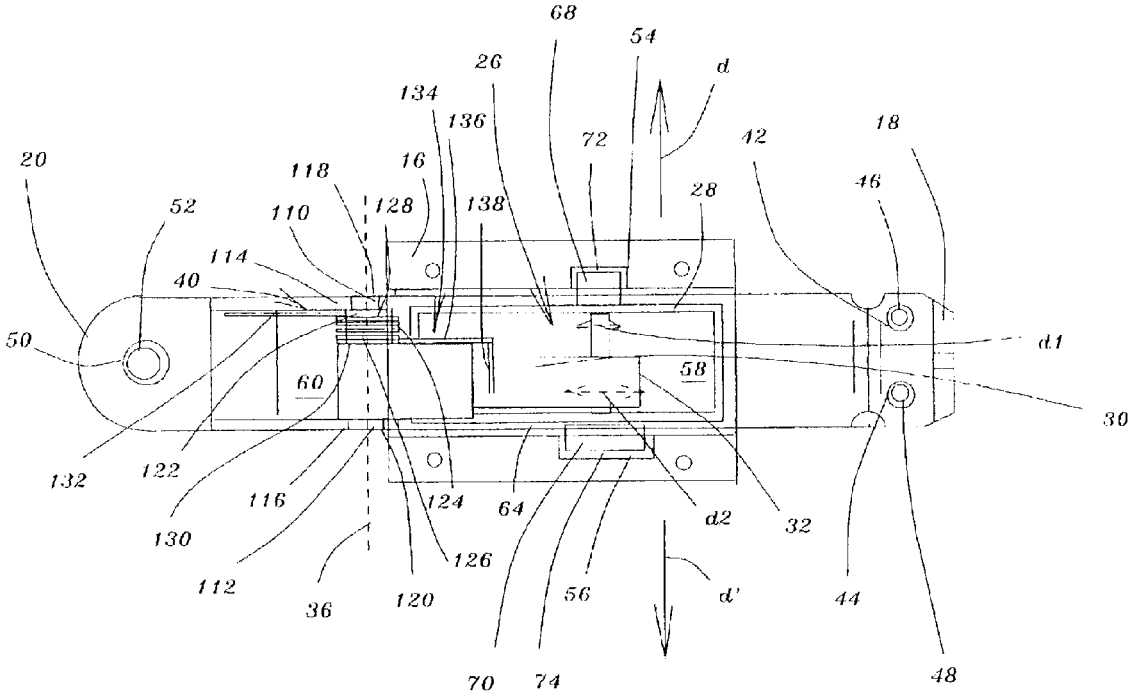
FIG. 4 is a view taken on the line 4—4 of FIG. 3.

FIG. 4 is a view taken on the line 4—4 of FIG. 3. As shown in FIG. 4, the first end 18 of the housing 16 defines a first and second aperture 42 and 44 respectively for the reception therein of fasteners 46 and 48 respectively for fastening the housing 16 to the door 12 of the vehicle 14. Also, the second end 20 of the housing 16 defines a hole 50 for the reception therein of fastener device 52 for fastening the housing 16 to the door 12 of the vehicle 14.

Furthermore, the housing 16 defines a first slot 54 and a second slot 56 that is disposed spaced and parallel relative to the first slot 54. The slots 54 and 56 respectively extend in the direction of movement D of the push button 28 as shown in FIG. 3.

Moreover, as shown in FIG. 4, the cavity 26 includes a first enclosure 58 of elongate rectangular-shaped cylindrical configuration for the slidable reception therein of the push button 28. The cavity 26 also includes a second enclosure 60 that extends from the first enclosure 58.

Also, as shown in FIG. 3, the push button 28 has a first and a second end 62 and 64 respectively, the first end 62 of the push button 28 defining an operating surface 66. The second end 64 of the push button 28 slides within the cavity 26.

Furthermore, as shown in FIG. 4, the second end 64 of the push button 28 defines a first and a second laterally extending ear 68 and 70 respectively. The ears 68 and 70 extend in opposite directions d and d' relative to each other. The directions d and d' are disposed normal to the direction of movement D of the push button 28. More specifically, the first ear 68 slides within the first slot 54 and the second ear 70 slides within the second slot 56 such that the push button 28 is guided by an interaction of the ears 68 and 70 within the respective slots 54 and 56.

The first ear 68 is of cylindrical configuration, the first ear 68 having an outer end 72 that has a first diameter d1. Also, the second ear 70 is of cylindrical configuration, the second ear 70 having an outer extremity 74 that has a second diameter d2. The second diameter d2 is greater than the first diameter d1. Additionally, as shown in FIG. 3, the outer end 72 defines a sloped sector 76 for assisting assembly of the push button 28 within the housing 16. Additionally, as shown in FIG. 1, the outer extremity 74 defines a further sloped sector 78 for assisting assembly of the push button 28 within the housing 16.

Figure 5:
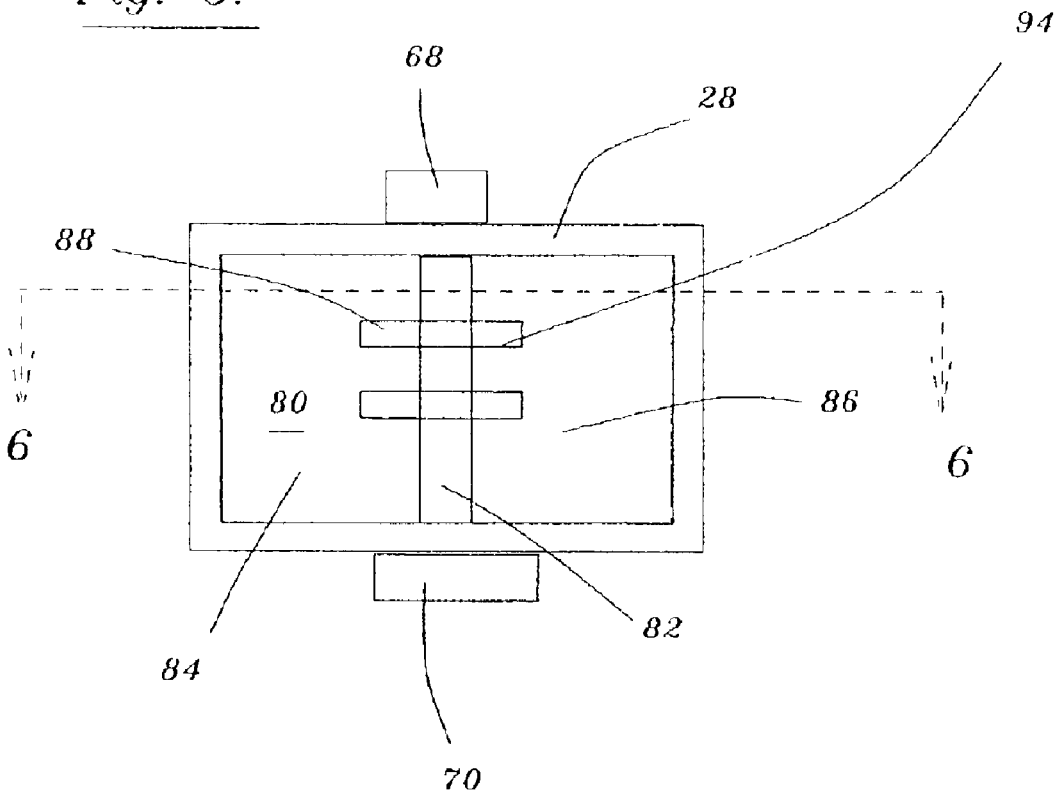
FIG. 5 is a view of the push button viewed from a second end thereof.

FIG. 5 is a view of the push button 28 viewed from the second end 64 thereof. As shown in FIG. 5, the push button 28 is of cup-shaped configuration, the push button 28 defining an internal expanse 80. The push button 28 includes a longitudinally extending wall 82 that divides the expanse 80 into a first and a second compartment 84 and 86 respectively. A first rib 88 extends from the wall 82.

Figure 6:
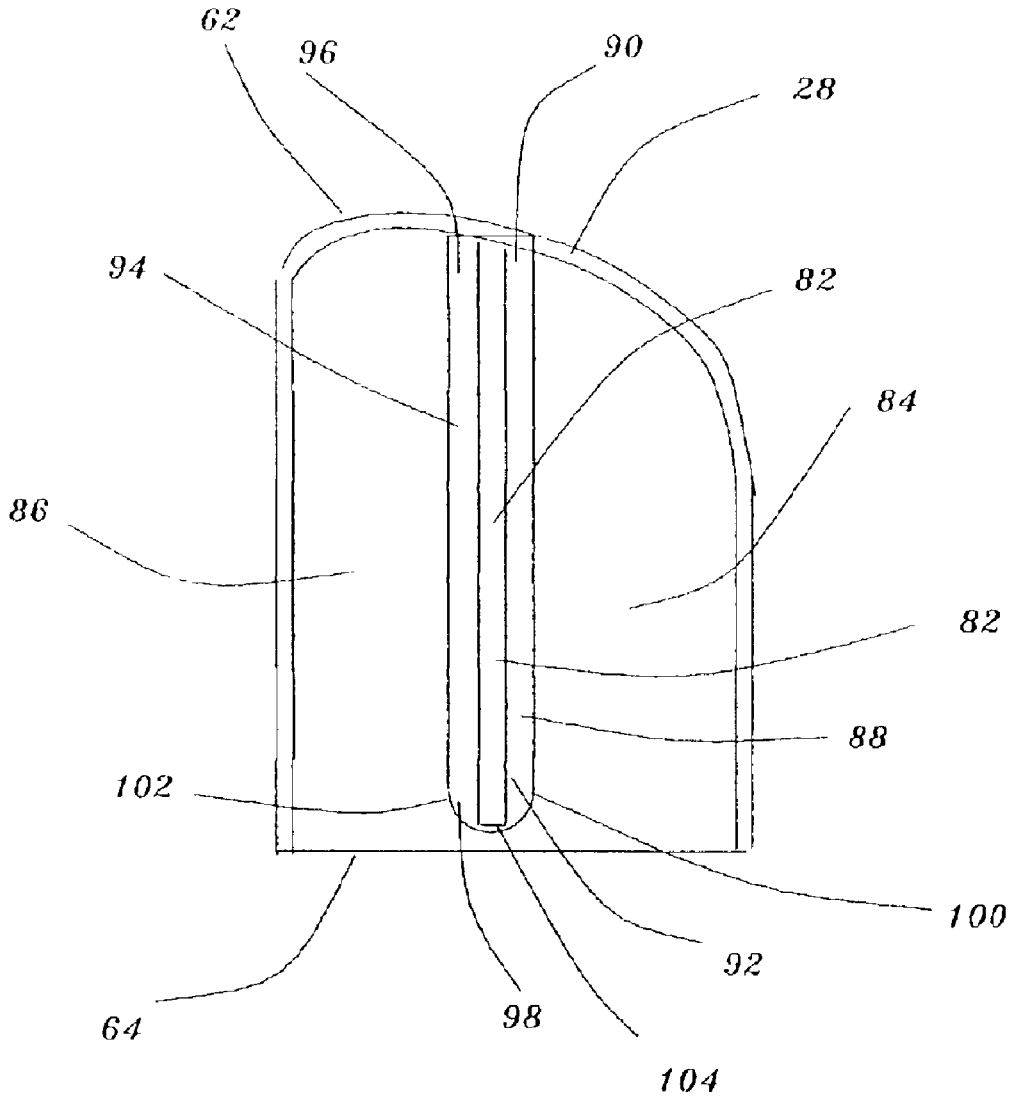
FIG. 6 is a view taken on the line 6—6 of FIG. 5.

FIG. 6 is a view taken on the line 6—6 of FIG. 5. As shown in FIG. 6, the first rib 88 has a first and a second extremity 90 and 92 respectively. The first extremity 90 of the first rib 88 is disposed adjacent to the first end 62 of the push button 28. Also, a second rib 94 extends from the wall 82 and away from the first rib 88, the second rib 94 being disposed spaced and parallel relative to the first rib 88. The second rib 94 has a first and a second extremity 96 and 98, the first extremity 96 of the second rib 94 being disposed adjacent to the first end 62 of the push button 28.

Moreover, the second extremity 92 of the first rib 88 defines a curved surface 100 that interacts with the cam surface 38. The second extremity 98 of the second rib 94 defines a further curved surface 102 which interacts with the cam surface 38, the curved surface 100 and the further curved surface 102 being adjacently positioned to define a generally convex surface 104 for cooperation with the cam surface 38. The arrangement is such that when the first end 62 of the push button 28 is depressed, the convex surface 104 slides along the cam surface 38 for pivoting the cam 30 about the pivotal axis 36.

In a preferred embodiment of the present invention, the cam surface 38 is substantially linear.

As shown in FIG. 1, the cam 30 includes a first portion 106 that extends from the first termination 32 to the pivotal axis 36. A second portion 108 extends from the second termination 34 to the pivotal axis 36. The first portion 106 extends approximately normal to the second portion 108.

As shown in FIG. 4, the cam 30 includes a first gudgeon 110 that is disposed coaxially relative to the pivotal axis 36. A second gudgeon 112 is disposed coaxially relative to the pivotal axis 36, the second gudgeon 112 projecting away from the first gudgeon 110. The arrangement is such that the gudgeons 110 and 112 extend through and are rotatably supported within a first and a second trunnion 114 and 116 respectively defined by the housing 16.

More particularly, the first gudgeon 110 defines a chamfered outer surface 118 for assisting assembly of the cam 30 within the housing 16. Also, the second gudgeon 112 defines a further chamfered outer surface 120 for further assisting assembly of the cam 30 within the housing.

Also, the cam 30 defines a post 122 that is disposed between the first gudgeon 110 and the second gudgeon 112 for the capture thereabout of the biasing device 40.

Preferably, the biasing device 40 is a spring 124. The spring 124 may be a torsional spring or coil spring or other suitable spring member capable of providing a biasing action. Moreover, although a particular arrangement for the spring 124 is shown and described herein, other suitable arrangements are acceptable. For example, one such alternative arrangement is that which is illustrated in the provisional application from which this case depends. As shown herein, the coil spring 124 includes a coil 126 having a first and a second extremity 128 and 130 respectively. The coil 126 is disposed coaxially about the pivotal axis 36 and is supported by the post 122. A first arm 132 extends from the first extremity 128 of the coil 126, the first arm 132 engaging and/or otherwise being anchored by the housing 16. Also, a second arm generally designated 134 extends from the second extremity 130 of the coil 126, the second arm 134 having a first and a second part 136 and 138 respectively. The first part 136 of the second arm 134 extends from the second extremity 130 of the coil 126. However, the second part 138 is bent relative to the first part 136, the second part 138 engaging and/or otherwise being anchored by the cam 30 between the pivotal axis 36 and the first termination 32 of the cam 30.

Moreover, as shown in FIG. 1, the second termination 34 of the cam 30 defines a cylindrical recess 140 and a radial slot 142 extending outwardly from the recess 140 and a groove 144 extending from the slot 142 around part of the circumference of the second termination 34. The apparatus 10 further includes a flexible cable 146 that has a first and a second end 148 and 150 respectively. The first end 148 of the cable 146 defines a head 152 that is received within the recess 140. The cable 146 is threaded through the slot 142 so that the cable 146 slides within the groove 144. A casing 154 for the cable 146 is provided so that the cable 146 slidably extends within the casing 154 so that when the push button 28 is depressed, the cable 146 moves relative to the casing 154 for releasing the door 12 of the vehicle 14.

Figure 7:
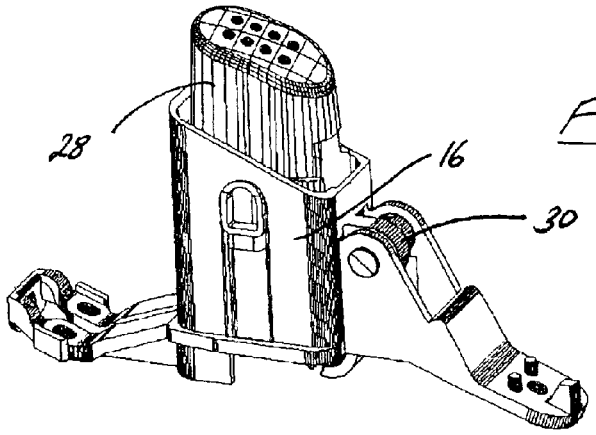
FIG. 7 is a perspective view of the assembled apparatus shown in FIGS. 1–6.

FIG. 7 is a perspective view of the assembled apparatus 10 shown in FIGS. 1–6. As shown in FIG. 7, the push button 28 moves within the housing 16 when the button 28 is depressed.

Figure 8:
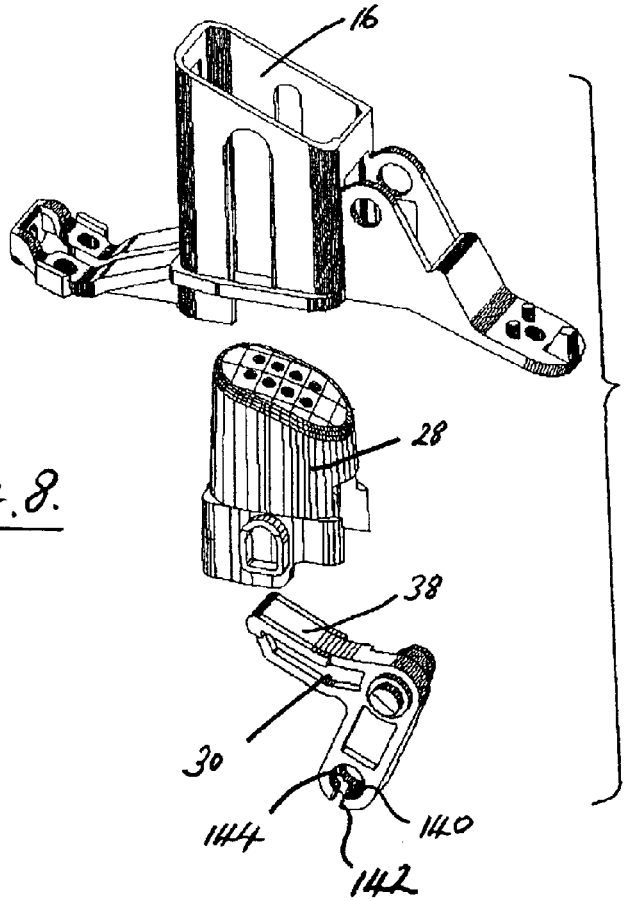
FIG. 8 is an exploded view of apparatus shown in FIG. 7.

FIG. 8 is an exploded view of the housing 16, the push button 28 and the cam 30. As shown in FIG. 8, the groove 144 extends from the radial slot 142.

Figure 9:
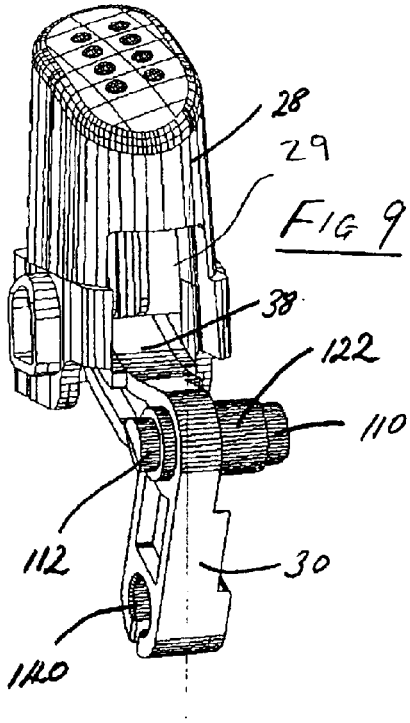
FIG. 9 is a further perspective view of the assembled apparatus shown in FIGS. 1–6.

FIG. 9 is a further perspective view of the assembled apparatus 10 shown in FIGS. 1–6. As shown in FIG. 9, the cam 30 includes the gudgeons 110 and 112 and the post 122 is provided for centering and supporting the coil spring 124.

Figure 10:
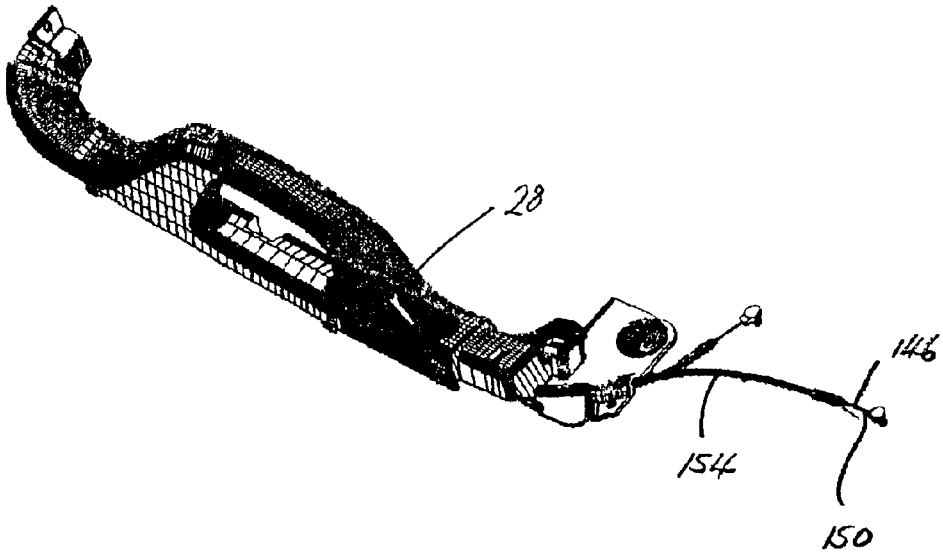
FIG. 10 is a perspective view of the apparatus shown in FIGS. 1–6 with the apparatus secured to a handle of a door of a mini-van.

FIG. 10 is a perspective view of the apparatus 10 shown in FIGS. 1–6 with the apparatus 10 secured to a handle of a door of a mini-van. As shown in FIG. 10, the cable 146 includes a second end 150 for releasing the door catch (not shown).

In operation of the apparatus 10, a user pushes on the push button 28 and as the push button 28 is depressed, it is guided along the first enclosure 58 by the ears 68 and 70 sliding within the slots 54 and 56. However, the convex surface 104 slides along the cam surface 38 and causes the cam 30 to pivot about the axis 36. Therefore, the second termination 34 of the cam 30 pulls the head 152 of the cable 146 for releasing the vehicle door 12. When the push button 28 is released, the coil spring 124 urges the cam 30 to rotate about the axis 36 for returning the push button 28 to the inoperative location thereof. Lastly, with reference to FIG. 9, it can be observed that the button 28 includes an opening or cut-out 29 which is adapted to receive a portion of the cam 30 during movement of the button 28.

The present invention provides a unique push button release apparatus for releasing a door of a vehicle.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A push button release apparatus for releasing a door of a vehicle, the door including a catch, said apparatus comprising:

a housing secured to the door of the vehicle, said housing having a first end a second end and a first and a second extremity, said housing defining a cavity which extends between said first and said second end of said housing, and said cavity extending between said first and said second extremities of said housing, said housing defining first and second spaced, parallel slots along said cavity;

a push button supported by said housing, said push button being slidably disposed relative to said housing such that said push button moves between an inoperative location disposed adjacent to said first extremity of said housing and an operative location disposed adjacent to said second extremity of said housing, said push button having a first and second end, said first end of said push button defining an operating surface, and said second end of said push button sliding within said cavity, said second end of said push button defining a first and a second laterally extending ear, said first and second ears extending in opposite directions relative to each other, said directions being normal to said direction of movement of said push button, said first ear sliding within said first slot, and said second ear sliding within said second slot such that said push button is guided by an interaction of said ears within said respective slots;

a cam having a first and a second termination, said cam being rotatably supported about a rotational axis which is disposed between said first and said second terminations of said cam, said rotational axis extending through said housing, and said first termination defining a cam surface which cooperates with said push button;

a cable having a first end connected to said second termination and a second end configured for connection to the catch of the door; and a biasing device connected to said cam for biasing said cam such that said cam surface urges said push button in a direction from said operative location towards said inoperative location thereof, so that when said push button is moved from said inoperative location towards said operative location in opposition to said biasing device, said push button engages said cam surface to cause said cam to rotate about said rotational axis, and said second termination of said cam is caused to move and to pull said cable to allow for the release of the door of the vehicle.

2. A push button release apparatus as set forth in claim 1, wherein said housing is fabricated from a plastics material.

3. A push button release apparatus as set forth in claim 1, wherein said housing is a one piece molding.

4. A push button release apparatus as set forth in claim 1, wherein said housing is injection molded.

5. A push button release apparatus as set forth in claim 1, wherein said first end of said housing defines a first and second aperture for the receipt therein of fasteners for fastening said housing to the door of the vehicle, and said second end of said housing defines a hole for the receipt therein of a fastener device for fastening said housing to the door of the vehicle.

6. A push button release apparatus as set forth in claim 1, wherein said cavity includes a first enclosure of elongate cylindrical configuration for the slidable reception therein of said push button, and a second enclosure extending from said first enclosure.

7. A push button release apparatus as set forth in claim 1, wherein said first ear is of cylindrical configuration, said first ear having an outer end that has a first diameter, said second ear is of cylindrical configuration, said second ear having an outer extremity which has a second diameter, said second diameter being greater than said first diameter, said outer end defining a sloped sector for assisting assembly of said push button within said housing, and said outer extremity defining a further sloped sector for assisting assembly of said push button within said housing.

8. A push button release apparatus as set forth in claim 1, wherein said push button is of cup-shaped configuration, said push button defining an internal expanse, said push button including a longitudinally extending wall that divides said expense into a first and a second compartment, a first rib extending from said wall, said first rib having a first and a second extremity, said first extremity of said first rib being disposed adjacent to said first end of said push button, a second rib extending from said wall and away from said first rib, said second rib being disposed spaced and parallel relative to said first rib, said second rib having a first and a second extremity, said first extremity of said second rib being disposed adjacent to said first end of said push button, said second extremity of said first rib defining a curved surface that interacts with said cam surface, said second extremity of said second rib defining a further curved surface which interacts with said cam surface, said curved surface and said further curved surface being joining together to define a generally convex surface for cooperating with said cain surface so that when said first end of said push button is depressed, said convex surface slides along said cam surface for rotating said cam about said rotational axis.

9. A push button release apparatus as set forth in claim 1, wherein said cam surface is linear.

10. A push button release apparatus as set forth in claim 1, wherein said cam includes a first portion that extends from said first termination to said rotational axis, a second portion that extends from said second termination to said rotational axis, and said first portion extending approximately normal to said second portion.

11. A push button release apparatus for releasing a door of a vehicle, the door including a catch, said apparatus comprising:

a housing secured to the door of the vehicle, said housing having a first and a second end and a first and a second extremity, said housing defining a cavity which extends between said first and said second end of said housing and said cavity extending between said first and said second extremities of said housing;

a push button supported by said housing said push button being slidably disposed relative to said housing such that said push button moves between an inoperative location disposed adjacent to said first extremity of said housing and an operative location disposed adjacent to said second extremity of said housing;

a cam having a first and a second termination, said cam being rotatably supported about a rotational axis which is disposed between said first and said second terminations of said cam, said rotational axis extending through said housing, and said first termination defining a cam surface which cooperates with said push button;

a cable having a first end connected to said second termination and a second end for connection to the catch of the door;

a biasing device connected to said cam for biasing said cam such that said cam surface urges said push button in a direction from said operative location towards said inoperative location thereof, so that when said push button is moved from said inoperative location towards said operative location in opposition to said biasing device, said push button engages said cam surface to cause said cam to rotate about said rotational axis, and said second termination of said cam is caused to move and to pull said cable to allow for the release of the door of the vehicle; and wherein said cam includes a first gudgeon disposed coaxially relative to said pivotal axis, a second gudgeon disposed coaxially relative to said pivotal axis, said second gudgeon projecting away from said first gudgeon such that said gudgeons extend through and are rotatably supported within a first and a second trunnion respectively defined by said housing.

12. A push button release apparatus as set forth in claim 11, wherein said first gudgeon defines a chamfered outer surface for assisting assembly of said cam within said housing, said second gudgeon defines a farther chamfered outer surface for assisting assembly of said cam within said housing.

13. A push button release apparatus as set forth in claim 11, wherein said cam defines post disposed between said first gudgeon and said second gudgeon for the capture thereabout of said biasing device.

14. A push button release apparatus for releasing a door of a vehicle, the door including a catch, said apparatus comprising:

a housing secured to the door of the vehicle, said housing having a first and a second end and a first and a second extremity, said housing defining a cavity which extends between said first and said second end of said housing, and said cavity extending between said first and said second extremities of said housing;

a push button supported by said housing, said push button being slidably disposed relative to said housing such that said push button moves between an inoperative location disposed adjacent to said first extremity of said housing and an operative location disposed adjacent to slid second extremity of said housing;

a cam having a first and a second termination, said cam being rotatably supported about a rotational axis which is disposed between said first and said second terminations of said cam, said rotational extending through said housing, and said first termination defining a cam surface which cooperates with said push button;

a cable having a first end connected to said second termination and a second end for connection to the catch of the door;

a biasing device connected to said cam for biasing said cam such that said cam surface urges said push button in a direction from said operative location towards said inoperative location thereof, so that when said push button is moved from said inoperative location towards said operative location in opposition to said biasing device, said push button engages said cam surface to cause said cam to rotate about said rotational axis, and said second termination of said cam is caused to move and to pull said cable to allow for the release of the door of the vehicle; and wherein said biasing device is a coil spring, said coil spring including a coil having a first end a second extremity, said coil being disposed coaxially about said rotational axis, a first arm extending from said first extremity of said coil, said first arm engaging and being anchored by said housing, a second arm extending from said second extremity of said coil, said second arm having a first and a second part, said first part extending from said second extremity of said coil, said second part being bent relative to said first part, said second part engaging and being anchored by said cam between said rotational axis and said first termination of said cam.

15. A push button release apparatus for releasing a door of a vehicle, the door including a catch, said apparatus comprising:

a housing secured to the door of the vehicle, said housing having a first and a second end and a first and a second extremity, said housing defining a cavity which extends between said first and said second end of said housing, and said cavity extending between said first and said second extremities of said housing;

a push button supported by said housing, said push button being slidably disposed relative to said housing such that said push button moves between an inoperative location disposed adjacent to said first extremity of said housing and an operative location disposed adjacent to said second extremity of said housing;

a cam having a first and a second termination, said cam being rotatably supported about a rotational axis which is disposed between said first and said second terminations of said cam, said rotational axis extending through said housing, and said first termination defining a cam surface which cooperates with said push button;

a cable having a first end connected to said second termination and a second end for connection to the catch of the door;

a biasing device connected to said cam for biasing said cam such that said cam surface urges said push button in a direction from said operative location towards said inoperative location thereof, so that when said push button is moved from said inoperative location towards said operative location in opposition to said biasing device, said push button engages said cam surface to cause said cam to rotate about said rotational axis, and said second termination of said cam is caused to move and to pull said cable to allow for the release of the door of the vehicle;

wherein said second termination of said cam defining a cylindrical recess, a radial slot extending outwardly from said recess, and a groove extending from said slut around part of a circumference of said second termination, said apparatus farther including:

said first end of said cable defining a bead which is received within said recess, said cable being threaded through said slot so that said cable slides within said groove; and a casing for said cable so that said cable slidably extends within said casing so that when said push button is depressed, said cable moves relative to said casing for releasing the door of the vehicle.

* * * * *